United States Patent [19]

Duprez

[11] Patent Number: 4,587,931

[45] Date of Patent: May 13, 1986

[54] PRESSURE COMPENSATED TEMPERATURE SWITCH UNIT FOR PROTECTION OF AN INTERNAL COMBUSTION ENGINE

[75] Inventor: Wayne R. Duprez, Waltham, Mass.

[73] Assignee: Standard-Thomson Corporation, Waltham, Mass.

[21] Appl. No.: 680,279

[22] Filed: Dec. 10, 1984

[51] Int. Cl.[4] ..... F01D 11/18

[52] U.S. Cl. ..... 123/41.15; 340/57; 374/145

[58] Field of Search ..... 123/41.15; 374/145, 374/203; 116/101-103; 340/57, 592

[56] References Cited

U.S. PATENT DOCUMENTS 3,753,256 8/1973 McDonald ..... 340/592
3,898,614 8/1975 Watt ..... 340/592
4,262,274 4/1981 Howe et al. ..... 374/203
4,299,117 11/1981 Andrews et al. ..... 374/145

FOREIGN PATENT DOCUMENTS 488838 7/1938 United Kingdom ..... 374/145

*Primary Examiner*—William A. Cuchlinski, Jr.
*Attorney, Agent, or Firm*—Jacox & Meckstroth

[57] ABSTRACT

A pressure compensated temperature switch for the protection of an internal combustion engine or the like. The switch unit includes a housing, a portion of which is positioned within a passage in the cooling system of the internal combustion engine. Within the housing is a pressure sensitive member. The pressure sensitive member senses both the temperature and the pressure of the coolant fluid in the coolant system of the internal combustion engine. A visual and/or audible alarm device which is connected to a switch unit of this invention, thus operates when temperature conditions exist within an engine which are harmful to the engine.

20 Claims, 7 Drawing Figures

PRESSURE COMPENSATED TEMPERATURE SWITCH UNIT FOR PROTECTION OF AN INTERNAL COMBUSTION ENGINE

BACKGROUND OF THE INVENTION

Most automotive internal combustion engines have a coolant system which includes fluid conduits within the engine and adjacent the engine, and a heat exchanger through which coolant liquid flows.

For the protection of the internal combustion engine against overheating an alarm, audible and/or visual, to the operator should be activated if the temperature of the engine becomes excessive.

One major consideration in the protection of an internal combustion engine is that the coolant fluid in the coolant system must remain substantially in liquid form and should not be permitted to boil. The boiling point of the coolant liquid depends upon the composition thereof and also depends upon the pressure applied to the coolant liquid within the coolant system.

A coolant system of an internal combustion engine usually is a closed system in which a pressure cap closes the passage through which the coolant liquid is introduced into the coolant system. The pressure cap is designed to maintain a predetermined operating pressure within the coolant system. If a predetermined operating pressure in the coolant system could always be precisely maintained, the problems involved with regard to protection of the engine would be significantly reduced. If a predetermined operating pressure were always maintained in the coolant system, monitoring of the temperature of the engine would be the principal requirement for protection of the engine. However, as a practical matter, the pressure in the coolant system cannot be properly or effectively controlled. This is due to the fact that the pressure cap is customarily one which has a pressure tolerance range. Also, an aging pressure cap permits a change in the operating pressure maintained in a coolant system. Furthermore, an aging coolant system becomes increasing subject to leakage.

Most engine protection devices sense only the temperature of the engine, and a temperature alarm condition is established based upon an anticipated operating pressure within the coolant system. In such systems a temperature alarm may be energized at a time in which temperature conditions do not justify an alarm, or an alarm may not be energized at a time in which the engine is subjected to damage conditions.

A coolant system which maintains less than an expected operating pressure permits the coolant liquid to boil at a temperature less than that for which the danger signal is designed to operate. Under such conditions, the coolant liquid may boil away and be lost from the coolant system without causing the alarm signal to be energized.

For these reasons, devices which have been designed to protect an internal combustion engine against overheating have not been effective.

Thus, it is understood that in order to properly protect an internal combustion engine against overheating, it is necessary to sense both the temperature and the pressure within the coolant system of the internal combustion engine.

It is an object of this invention to provide a switch unit for protection of an internal combustion engine in which the unit senses both the temperature and pressure of the liquid in the coolant system and which operates as a function of both the temperature and pressure of the liquid.

Another object of this invention is to provide such a switch unit which is capable of operating and compensating as a function of both the temperature and pressure of a specific liquid in the coolant system.

Another object of this invention is to provide such a switch unit which has relatively long life and which may be produced at relatively low costs.

Other objects and advantages of this invention reside in the construction of parts, the combination thereof, the method of production and the mode of operation, as will become more apparent from the following description.

BRIEF DESCRIPTION OF THE VIEWS OF THE DRAWINGS

FIG. 1 illustrates a switch unit 10 of this invention as it is mounted in a wall 12 of a fluid conduit 13 of a coolant system of an internal combustion engine. The conduit 13 forms a passage 14 which is enclosed by the wall 12 and which contains a coolant liquid therewithin. The coolant liquid flows through the conduit 13, through the engine and through a heat exchanger, not shown.

Figure 1:
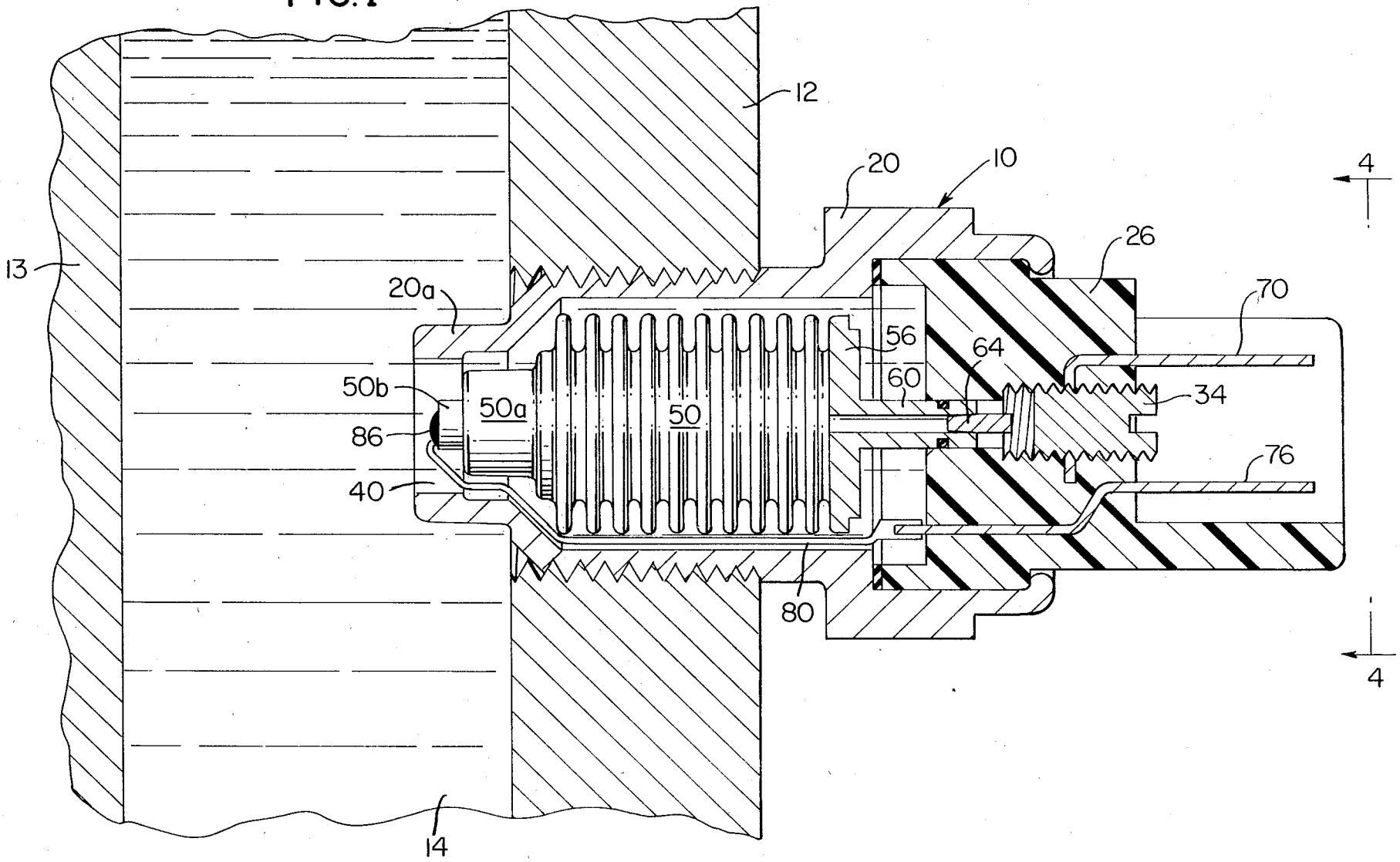
FIG. 1 is a side sectional view of a switch unit of this invention, as the switch unit is installed in association with the engine coolant system of an internal combustion engine. This figure illustrates the switch unit in a de-actuated condition.
Figure 2:
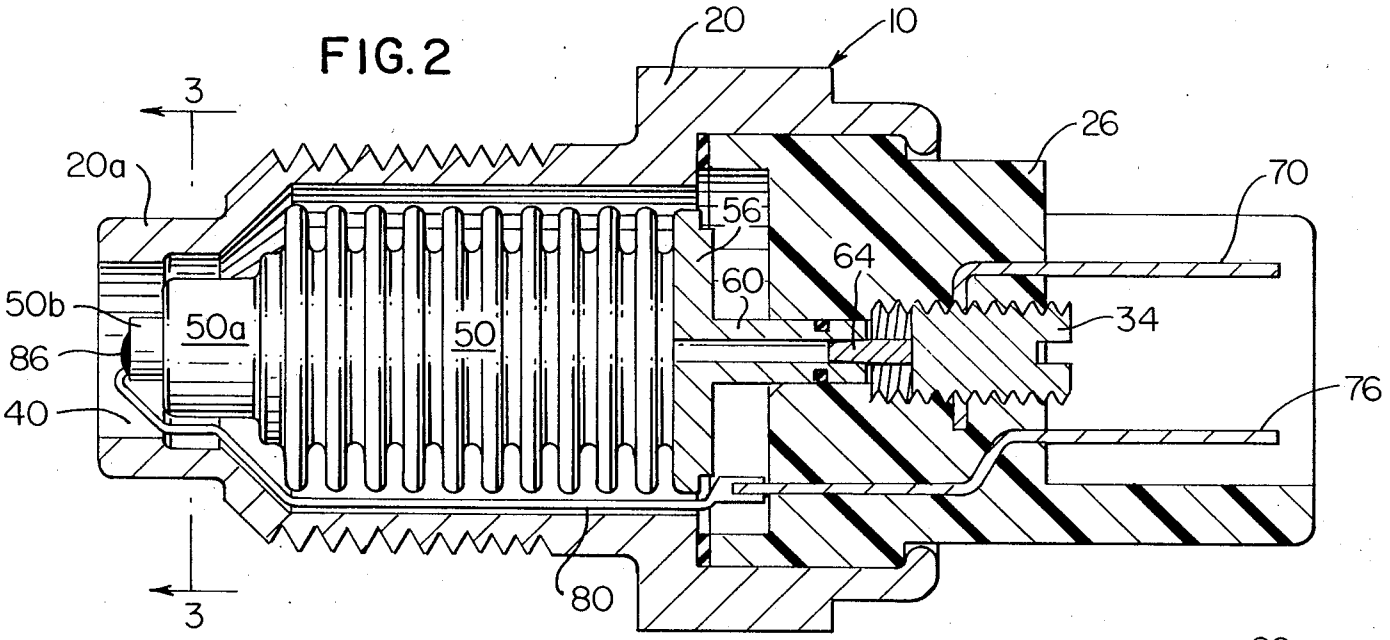
FIG. 2 is a side sectional view, similar to FIG. 1, and illustrates the switch unit in an actuated condition.
Figure 4:
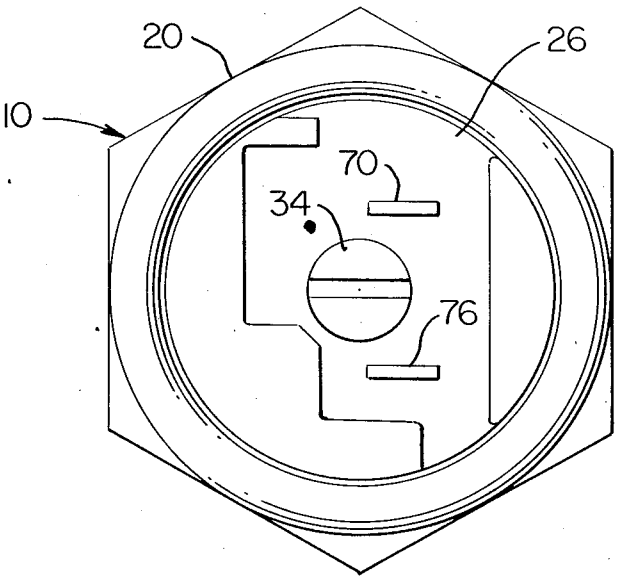
FIG. 4 is an elevational view taken substantially on line 4—4 of FIG. 1.

The switch unit 10 comprises a housing 20 which is threaded into the wall 12. Secured within one end portion of the housing 20 is a support member 26 which is of electrically non-conductive material, such as a plastics material or the like. Shown threaded within the support member 26 is an electrically conductive contact member 34.

Figure 3:
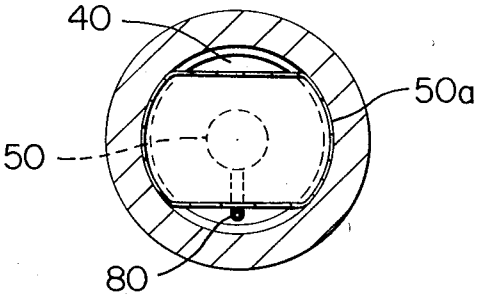
FIG. 3 is a sectional view taken substantially on line 3—3 of FIG. 2.

The housing 20 has an end portion **20*a* which is within the passage 14. The end portion 20*a* has an opening 40 which leads into the housing 20 and which provides liquid communication between the passage 14 and the interior of the housing 20. A bellows 50 is positioned within the housing 20 and extends longitudinally within the housing 20. The bellows 50 has a bulb end portion 50*a* which is shown as being elongate in cross section and which is secured within the opening 40 in the end portion 20*a* of the housing 20, as illustrated in FIG. 3. The end portion 20*a* thus secures the bellows 50 to the housing 20 but permits flow of liquid between the passage 14 and the interior of the housing 20**.

The end of the bellows 50 opposite the bulb end portion 50*a* includes a rigid panel 56 to which is attached a tubular stem 60. The tubular stem 60 is closed by an engagement member 64 which extends therefrom. The tubular stem 60 is slidably axially movable within the support member 26. Under normal conditions within the bellows 50, the tubular stem 60 is positioned so that the engagement member 64 is spaced from the contact member 34, as illustrated in FIG. 1. The bellows 50, the panel 56, the stem 60, and the engagement member 64 are of an electrically conductive material.

Attached to the contact member 34 is an electrical conductor 70, which extends from the support member 26. Also extending through the support member 26 is an electrical conductor 76 which is connected to an electrical conductor 80 which extends along the bellows 50 and which is joined to a thermistor 86 or any electrical device in which the resistance thereof varies significantly with the temperature thereof. The thermistor 86 is attached to a protuberant part 50*b* of the bulb portion 50*a* of the bellows 50.

Coolant liquid flows through the passage 14, and some of the coolant liquid flows into the housing 20 through the opening 40 and surrounds the bellows 50. The bellows 50 is evacuated and is partially filled with a vaporizable liquid. The vaporizable liquid within the bellows 50 is preferably a solution having substantially the same formulation as the coolant liquid in the passage 14, i.e., a solution of about fifty percent glycol and fifty percent water. The bellows 50 is evacuated and filled through the stem 60, and the engagement member 64 closes the bellows 50.

OPERATION

The housing 20 is constructed of electrically conductive material and is firmly attached to the wall 12 as illustrated in FIG. 1. The wall 12 is of electrically conductive material and serves as a "ground" connection in electrical circuits, discussed below.

A portion of the coolant liquid which flows through the passage 14 also flows through the opening 40 into the housing 20 and surrounds the bellows 50. The coolant liquid is heated as the coolant liquid flows through the engine during operation of the engine. The boiling point of the coolant liquid is directly related to the pressure thereof within the engine cooling system. If the pressure of the coolant liquid is greater, the temperature at which the coolant liquid vaporizes or boils is greater.

The pressure which exists within the passage 14 is the same pressure which exists within the housing 20 and which is applied to the exterior of the bellows 50. The pressure applied to the exterior of the bellows 50 tends to restrain the bellows 50 against expansion in length. The coolant liquid within the housing 20 transfers heat through the bellows 50 into the liquid within the bellows 50. When the temperature of the liquid within the bellows 50 is sufficient, the liquid within the bellows 50 vaporizes or boils and applies a pressure within the bellows 50 which urges the bellows 50 to expand in length. If the temperature of the liquid within the bellows 50 increases sufficiently, the vapor pressure within the bellows 50 forces the bellows 50 to expand against the pressure applied by the coolant liquid to the exterior of the bellows 50. As the bellows 50 expands, the stem 60 and the engagement member 64 are moved toward the contact member 34. If there is sufficient expansion of the length of the bellows 50, the engagement member 64 engages the contact member 34, and an electrical circuit is established through the conductor 70 to an alarm device, not shown. To provide an electrical circuit to the alarm device, the alarm device is also electrically connected to "ground" and to the wall 12 and to the housing 20, through the bellows 50 and to the engagement member 64.

Thus, external pressure upon the bellows 50 is compensated by the pressure of the vapor of the liquid within the bellows 50. As stated, preferably, the liquid within the bellows 50 is of substantially the same composition as the coolant liquid which flows through the passage 14. Therefore, the liquid within the bellows 50 vaporizes under the same temperature and pressure conditions as the coolant liquid exterior of the bellows 50. Therefore, the pressure and temperature of the coolant liquid which is applied to the exterior surface of the bellows 50 is accurately compensated by response of the liquid within the bellows 50 to temperature and pressure conditions within the bellows 50. When the vapor pressure within the bellows 50 with respect to the liquid and/or vapor pressure external of the bellows 50 is sufficient, the bellows 50 expands to move the engagement member 64 into engagement with the contact member 34 to establish a portion of an electrical circuit. As shown, the contact member 34 is threadedly adjustable for adjustment of the temperature at which the electrical circuit is closed.

If there should be a leak in the engine coolant system, or for some other reason, the coolant system does not have liquid therein, operation of the engine results in heating of the wall 12. The heat in the wall 12 is transmitted through the bulb end portion 50*a* to the bellows 50. The liquid within the bellows 50 thus is heated and vaporizes and forces expansion of the bellows 50. When this occurs, the engagement member 64 engages the contact member 34, and an alarm is energized in the manner discussed above.

A temperature indicator instrument, not shown, which is observable by an operator of the engine is connected by means, not shown, to the electrical conductor 76. As shown, the conductor 76 is connected through the conductor 80 to the thermistor 86. The electrical resistance of the thermistor 86 changes significantly with the temperature of the thermistor 86. Therefore, as the thermistor 86 functions in an electrical circuit of which an indicator instrument is a part, the indicator instrument constantly indicates the temperature of the coolant liquid in the coolant conduit 14 and/or the temperature of the wall 12.

Figure 5:
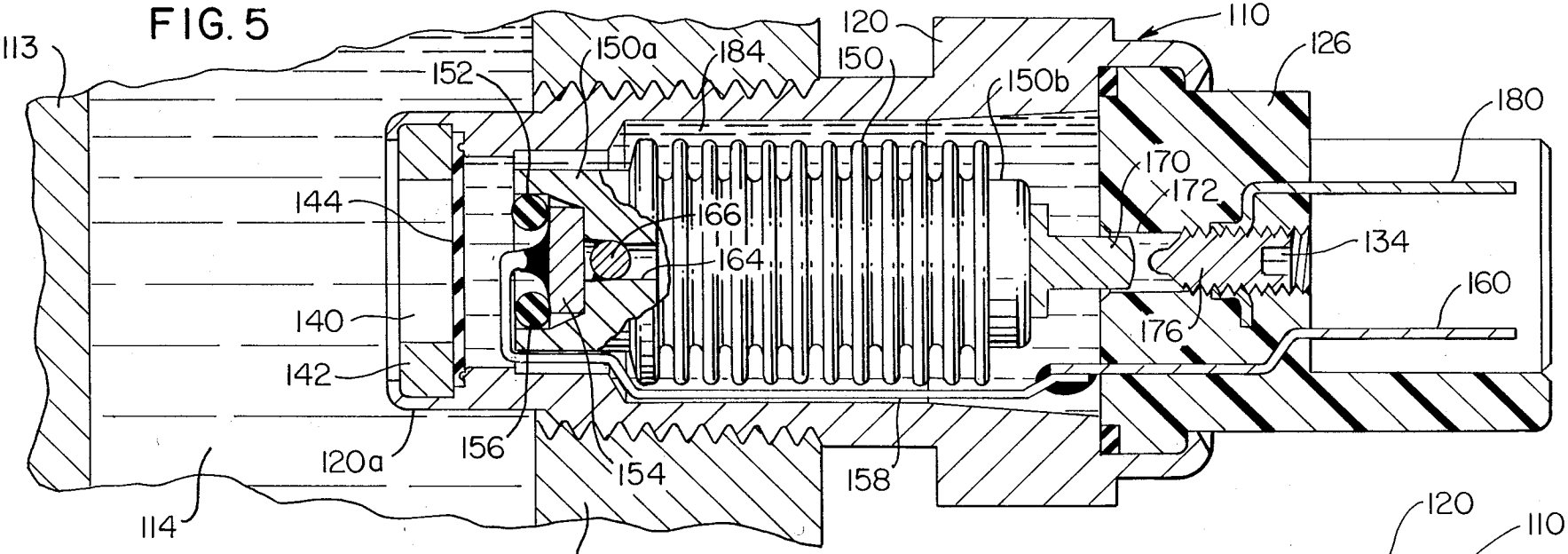
FIG. 5 is a side sectional view, similar to FIG. 1, showing another embodiment of the switch unit of this invention installed in association with the engine coolant system of an internal combustion system. This figure shows thc switch unit in a deactuated condition.
Figure 6:
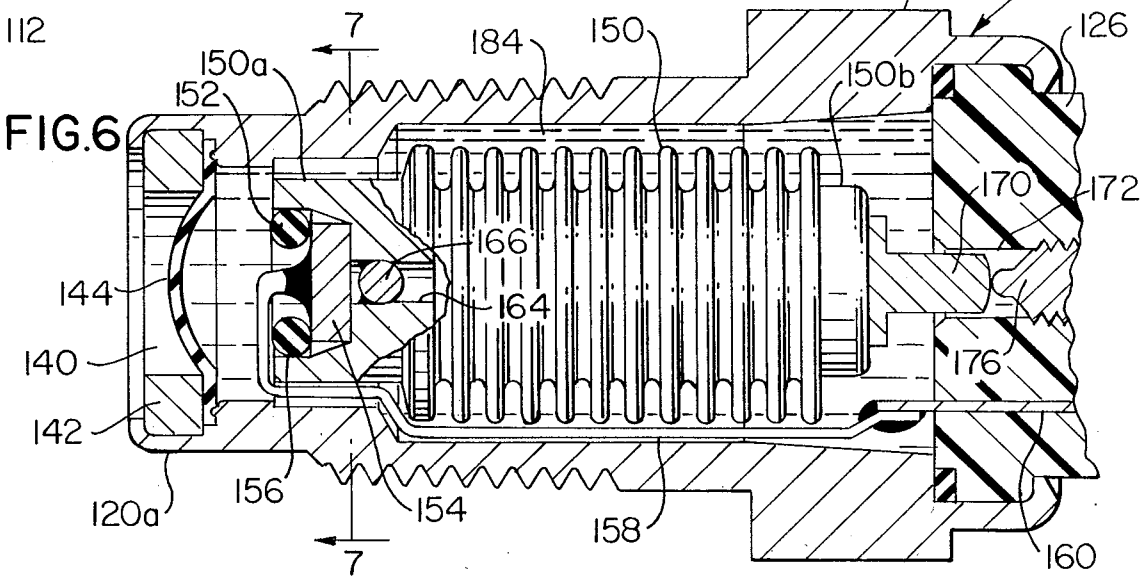
FIG. 6 is a side sectional view of the embodiment shown in FIG. 5 and illustrates the switch unit in an actuated condition.
Figure 7:
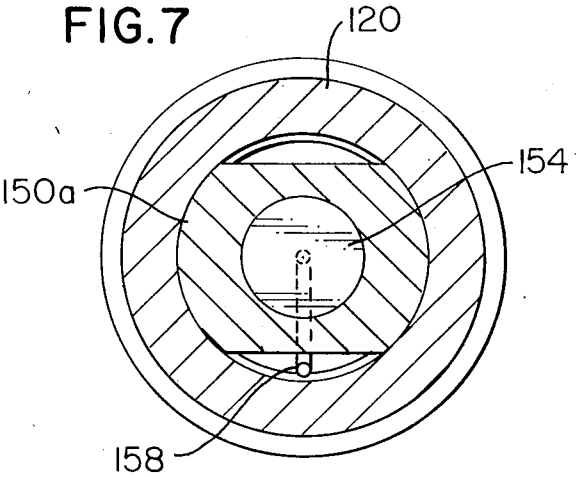
FIG. 7 is a sectional view taken substantially on line 7—7 of FIG. 6. cl DETAILED DESCRIPTION OF THE INVENTION

FIGS. 5, 6, and 7

FIGS. 5, 6, and 7 show another embodiment of the switch unit of this invention.

FIG. 5 illustrates a switch unit 110 of this invention as it is mounted in a wall 112 of a fluid conduit 113 of a coolant system of an internal combustion engine. The conduit 113 forms a conduit passage 114 which is enclosed by the wall 112 and which contains a coolant liquid therewithin which flows through the engine and through a heat exchanger, not shown.

The switch unit 110 comprises a housing 120 which is shown as being threadedly attached to the wall 112. As shown in FIG. 5, attached to the right hand portion of the housing 120 is a support member 126 which is of electrically non-conductive material, such as a plastics material or the like. Within the support member 126 is an electrically conductive contact member 134.

Opposite the support member 126 the housing 120 has an end portion 120*a* which is within the conduit passage 114. The end portion 120*a* of the housing 120 has an opening 140 which leads into the interior of the housing 120. Within the end portion 120*a* of the housing 120 is a rigid retainer ring 142 which secures an elastomeric diaphragm 144 within the end portion 120*a*. An elongate bellows 150 is positioned within the housing 120. The bellows 150 has a solid end portion 150*a*, which is best shown in FIG. 7 as being elongate in transverse dimension and is secured within the end portion 120*a* of the housing 120. As shown in FIG. 7, in view of the fact that the end portion 120*a* is elongate, fluid can flow between the end portion 120*a* and interior walls of the housing 120.

Within the end portion 150*a* of the bellows 150 is a recess 152. Within the recess 152 is a thermistor 154 or any electrical device in which the resistance thereof or voltage thereacross varies significantly with the temperature thereof. The thermistor 154 is retained within the recess 152 by means of an elastomeric retainer ring 156. An electrical conductor 158 is attached to the thermistor 154 and extends therefrom along the bellows 150 and is joined to a connection terminal 160. The thermistor 154 is also electrically joined to the end portion 150*a* of the bellows 150, which is of electrically conductive material. The housing 120, to which the end portion 150*a* of the bellows 150 is joined is also of electrically conductive material. Thus, a "ground" connection for the thermistor 154 to the electrical system of the engine is established through the bellows 150 and the housing 120.

A passage 164 extends through the end portion 150*a* of the bellows 150 and into the bellows 150. A limited quantity of liquid is introduced into the bellows 150 through the passage 164. Preferably, the liquid introduced into the bellows 150 has substantially the same composition as the composition of the liquid in the conduit passage 114 and within the entire coolant system of the engine. After liquid is introduced into the bellows 150 through the passage 164, the passage 164 is closed by means of a closure member 166 which is inserted into the passage 164.

The bellows 150 has a movable end portion 150*b*, which is opposite the end portion 150*a*. The end portion 150*b* is movable with expansion and contraction of the bellows 150. Attached to the movable end portion 150*b* is a stem 170. With expansion of the bellows 150 and with movement of the end portion 150*b*, the stem 170 is slidably axially movable within an opening 172 in the support member 126. The stem 120 is of electrically conductive material. Within the opening 172 in the end portion 126 is a stationary electrical contact member 176. Attached to the electrical contact member 176 and extending from the support member 126 is an electrical conductor 180.

Within the housing 120 and enclosed by the diaphragm 144 is a liquid 184 which is a good heat transfer medium, which is incompressible, and which has good dielectric characteristics. The liquid 184 encompasses the bellows 150.

OPERATION

The housing 120 is constructed of electrically conductive material and is firmly attached to the wall 112 as illustrated in FIG. 5. The wall 112 is of electrically conductive material and serves as a "ground" connection in the electrical system of the engine with which the switch unit of this invention is associated.

A portion of the coolant liquid which flows through the conduit passage 114 also flows through the opening 140 into the housing 120 and engages the diaphragm 144. The pressure of the coolant liquid in the coolant system and within the conduit passage 114 is transmitted through the diaphragm 144 to the liquid 184 which encompasses the bellows 150 within the housing 120.

The coolant liquid is heated as the coolant liquid flows through the engine during operation of the engine. The coolant liquid within the coolant conduit passage 114 transfers heat directly to the end portion 120*a* of the housing 120, and to the housing 120 through the wall 112. Heat then is transmitted through the liquid 184, to the bellows 150 and through the bellows 150 into the liquid within the bellows 150. The temperature of the liquid flowing within the coolant conduit 114 is, substantially the same temperature which exists in the liquid within the bellows 150. If the temperature of the liquid in the coolant conduit passage 114 reaches a magnitude in which the liquid boils or vaporizes, the temperature of the liquid within the bellows 150 causes the liquid within the bellows 150 to vaporize. The liquid within the bellows 150 vaporizes or boils and applies a pressure within the bellows 150 which urges the bellows 150 to expand in length. If the temperature of the liquid within the bellows 150 increases sufficiently, the vapor pressure within the bellows 150 forces the bellows 150 to expand against the pressure applied by the liquid 184 which encompasses the bellows 150. The boiling point of the coolant liquid in the coolant system is directly related to the pressure applied to the coolant liquid within the engine coolant system. If the pressure of the coolant liquid is greater, the temperature at which the coolant liquid vaporizes or boils is greater.

The pressure which exists within the conduit passage 114 is the same pressure which is applied to the diaphragm 144 within the end portion 120*a* of the housing 120. The pressure applied to the diaphragm 144 is transmitted to the liquid 184 which fills the housing 120 and surrounds and encompasses the bellows 150. Thus, the pressure of the coolant fluid within the conduit passage 114 is transmitted through the diaphragm 144 to the liquid 184 within the housing 120. The pressure of the liquid 184 within the housing 120 is applied to the exterior of the bellows 150. The pressure applied to the exterior of the bellows 150 tends to restrain the bellows 150 against expansion in length. As the bellows 150 expands, the bellows 150 increases in volume and due to the fact that the bellows 150 is within the liquid 184, which completely fills the housing 120, expansion of the bellows 150 causes the liquid 184 to force the diaphragm 144 outwardly, as illustrated in FIG. 6. Also, as the bellows 150 expands in length, the stem 170 is moved toward the contact member 176. If there is sufficient expansion of the length of the bellows 150, the stem 170 engages the contact member 176, and an electrical circuit is established through the conductor 180 to an alarm device, not shown.

If there should be a leak in the engine coolant system, or for some other reason, the coolant system does not contain a sufficient quantity of coolant liquid to maintain the engine at a proper temperature, operation of the engine results in excessive heating of the wall 112. The heat in the wall 112 is transmitted through the bellows 150, through the liquid 184, and into the bellows 150. The liquid within the bellows 150 thus is heated and vaporizes and forces expansion of the bellows 150. When this occurs, the stem 170 engages the contact member 176, as illustrated in FIG. 6, and the alarm is energized in the manner discussed above.

The pressure within the coolant system and within coolant conduit 114 is transmitted through the diaphragm 144 to the liquid 184 which is within the housing 120. Pressure of the liquid 184 within the housing 120 opposes expansion of the bellows 150. Therefore, in order for the bellows 150 to expand sufficiently to cause the stem 170 to engage the contact member 176, the pressure within the bellows 150 must be greater when the pressure of the liquid in the coolant system is greater. The pressure of the fluid within the bellows 150 is dependent upon the temperature of the fluid within the bellows 150. As stated, the temperature of the fluid within the bellows 150 is substantially the same as the temperature of the liquid in the coolant system and/or the temperature of the wall 112.

Thus, it is to be understood that there is an infinite number of pressure-temperature conditions at which the stem 170 engages the contact member 176 to actuate an alarm. Each alarm actuation position is directly related to a given temperature-pressure condition of the liquid in the coolant system.

A proper response by the operator of the engine to alarm conditions will result in avoidance of loss of coolant liquid and thus avoidance of damage to the engine.

A temperature indicator instrument, not shown, which is observable by an operator of the engine, is connected by means not shown to the electrical conductor 160. As shown, the conductor 160 is connected to the thermistor 154. The electrical resistance of the thermistor 154 changes significantly with the temperature of the thermistor 154. Thus, through functioning of the thermistor 154 which is in contact with the liquid 184 in the housing 120, a temperature indicator instrument which is connected to the thermistor 154 always indicates the temperature of the coolant liquid in the coolant conduit 114 and/or the temperature of the wall 112.

Therefore, in summary, whether or not fluid exists within a coolant system in which a switch unit of this invention is positioned, the switch unit of this invention automatically operates to indicate that temperature conditions harmful to the engine exist when such harmful temperature conditions actually exist and only when harmful temperature conditions exist.

Although the preferred embodiment of the engine protective switch unit of this invention has been described, it will be understood that within the purview of this invention various changes may be made in the form, details, proportion and arrangement of parts, the combination thereof, and the mode of operation, which generally stated consists in an engine protective swith unit within the scope of the appended claims.

The invention having thus been described, the following is claimed:

1. An engine protective switch unit adapted to be mounted in a coolant system of an internal combustion engine for operation of an engine protective monitoring device, the coolant system having a flow passage through which coolant liquid flows, comprising a housing provided with a cavity therein, the housing having an opening which provides communication between the flow passage of the coolant system and the cavity within the housing, pressure responsive means within the cavity of the housing and having a movable portion which is subject to pressure within the cavity, an electrical contact member, means attaching the electrical contact member to the movable portion of the pressure sensitive means for movement of the electrical contact member with movement of the movable portion of the pressure responsive means, an electrical engagement member adjacent the electrical contact member and engageable by the electrical contact member with movement of the movable portion of the pressure responsive means, vaporizable liquid within the pressure responsive means, the vaporizable liquid being heated by the coolant liquid and vaporizable to apply internal pressure upon the movable portion of the pressure responsive means for movement of the movable portion of the pressure responsive means, the electrical contact member being movable into engagement with the electrical engagement member by vapor pressure within the pressure responsive means which forces movement of the movable portion of the pressure responsive means.

2. The engine protective switch unit of claim 1 in which the pressure responsive means comprises a bellows.

3. The engine protective switch unit of claim 1 in which the vaporizable liquid within the pressure responsive means has substantially the same composition as the coolant liquid which flows in the flow passage of the coolant system.

4. The engine protective switch unit of claim 1 in which the pressure responsive means is attached to the housing.

5. The engine protective switch unit of claim 1 which includes an electrical thermistor device positioned for engagement by liquid which flows in the flow passage of the coolant system.

6. The engine protective switch unit of claim 1 which includes an electrical device which changes resistance with changes in the temperature thereof, the electrical device being positioned within the cavity of the housing.

7. The engine protective switch unit of claim 1 in which the pressure responsive means is attached to the housing at a position adjacent the opening in the housing.

8. The engine protective switch unit of claim 1 in which the engagement member is adjustable with respect to the electrical contact member.

9. The engine protective switch unit of claim 1 which includes a diaphragm which extends across the opening and encloses the cavity of the housing, fluid within the cavity of the housing and encompassing the pressure responsive means and filling the space in the cavity which is not occupied by the pressure responsive means.

10. The engine protective switch unit of claim 1 which includes an electrical device in which the electrical resistance thereof varies with the temperature thereof, the electrical device being positioned to be responsive to the temperature of the coolant liquid within the coolant system.

11. An engine protective switch unit which is adapted to be associated with the coolant system of an internal combustion engine in which coolant fluid flows within the coolant system, comprising:

a housing provided with a cavity therein, the housing having an opening therein to provide communication between the coolant system and the cavity in the housing, a wall having movable portions within the opening and separating the cavity from the exterior of the housing, a pressure sensitive device within the cavity and having a movable portion, the movable portion including an electrically conductive engagement part, a quantity of vaporizable liquid within the pressure sensitive device and expandable to move the movable portion of the pressure sensitive device, an electrical contact member engageable by the engagement part, a liquid encompassing the pressure sensitive device and filling the cavity so that external pressure applied to the movable wall is transmitted through the movable wall to the liquid in the cavity and to the pressure sensitive device, wherein the pressure and temperature of the coolant fluid within the coolant system is transmitted to the pressure sensitive device and to the vaporizable liquid therewithin, the movable portion of the pressure sensitive device thus moving in accordance with the pressure and temperature of the coolant fluid in the coolant system and wherein the electrically conductive engagement part moves with movement of the movable portion of the pressure sensitive device, the electrically conductive engagement part moving into contact with the electrical contact member upon sufficient movement of the electrically conductive engagement part.

12. The engine protective switch of claim 11 which includes an electrical device within the cavity of the housing, the electrical device being a device in which the resistance thereof varies significantly with the temperature thereof.

13. The engine protective switch of claim 11 in which the pressure responsive device within the cavity of the housing is a bellows member having a portion attached to the housing and a movable portion movable with respect to the housing.

14. An engine protective switch unit adapted to be positioned adjacent a fluid conduit of a coolant system of an internal combustion engine, comprising a housing, the housing having an opening which provides fluid communication between the fluid conduit and the interior of the housing, a bellows within the housing, means attaching a portion of the bellows to the housing, a quantity of fluid within the bellows and expandable to expand the bellows, the bellows having a movable portion which is movable with expansion and contraction of the bellows, an electrically conductive contact member movable by the movable portion of the bellows, an electrically conductive engagement member engageable by the electrically conductive contact member with expansion of the bellows, wherein engagement of the electrically conductive contact member with the electrically conductive engagement member establishes a portion of an electrical circuit, wherein fluid within the fluid conduit of the coolant system and within the housing applies pressure and heat to the external portions of the bellows, the fluid within the bellows expanding in volume in response to sufficient heat within the bellows to apply a pressure within the bellows to move the movable portion of the bellows to move the electrically conductive contact member into engagement with the electrically conductive engagement member.

15. The engine protective switch unit of claim 14 in which the electrically conductive contact member is attached to the movable portion of the bellows for movement with the movable portion of the bellows.

16. The engine protective switch unit of claim 14 in which the housing includes a support portion of electrical insulator material, and in which the electrically conductive engagement member is carried by the support portion of the insulator material.

17. The engine protective switch of claim 14 in which the fluid in the bellows is a vaporizable liquid.

18. The engine protective switch of claim 14 in which the coolant system contains a liquid and in which the fluid in the bellows has substantially the same composition as the liquid in the coolant system.

19. The engine protective switch unit of claim 14 which includes an electrical resistance device positioned within the housing, the electrical resistance device being of the type in which the electrical resistance thereof varies significantly with variations in the temperature of the electrical resistance device, wherein the electrical resistance device is adapted to be electrically connected to an engine monitoring instrument.

20. The engine protective switch unit of claim 14 in which the housing has a cavity therein and in which the opening in the housing leads to the cavity, a diaphragm extending across the opening and separating the cavity from the exterior of the housing, the bellows being positioned within the cavity, a liquid within the cavity and encompassing the bellows, the liquid encompassing the bellows and filling the cavity and transmitting pressure and temperature to the bellows and to the fluid within the bellows.

* * * * *